United States Patent [19]

Hancock

[11] Patent Number: 4,565,521

[45] Date of Patent: Jan. 21, 1986

[54] SAFETY PILOT BURNERS

[75] Inventor: John Hancock, Leeds, England

[73] Assignee: Geo. Bray & Co. Limited, Leeds, England

[21] Appl. No.: 498,373

[22] Filed: May 26, 1983

[51] Int. Cl.[4] ..... F23D 13/00

[52] U.S. Cl. ..... 431/75; 431/354; 239/455

[58] Field of Search ..... 431/75, 89, 355, 354; 137/79; 239/455, 75; 251/11

[56] References Cited

U.S. PATENT DOCUMENTS

| | | | |
|---|---|---|---|
| 717,278 | 12/1902 | Riess et al. | 431/355 |
| 726,249 | 4/1903 | Brachhausen | 239/455 |
| 1,513,622 | 10/1924 | Manning | 432/58 |
| 1,874,970 | 4/1931 | Hall | 239/434 |
| 1,914,905 | 6/1933 | Barber | 239/434 |
| 2,355,216 | 8/1944 | Guelson | 431/75 |
| 2,652,108 | 9/1953 | Jenkins | 431/75 |
| 3,635,646 | 1/1972 | Cox | 431/89 |

FOREIGN PATENT DOCUMENTS

| | | | |
|---|---|---|---|
| 0230775 | 2/1909 | Fed. Rep. of Germany | 431/75 |

*Primary Examiner*—Samuel Scott
*Assistant Examiner*—Helen A. Odar
*Attorney, Agent, or Firm*—David A. Jackson; Daniel H. Bobis

[57] ABSTRACT

In a gas burning installation a pilot burner is provided with means to control the amount of atmospheric air introduced into the fuel gas in the burner tube, the means comprising a restriction in the tube upstream of where air enters and a variable choke downstream of where air enters, which choke affects the resistance to the flow of gas along the tube.

1 Claim, 3 Drawing Figures

SAFETY PILOT BURNERS

The invention relates to apparatus for controlling the induction of ambient gas into a fluid stream and particularly but not exclusively for controlling the ingress of primary air into a stream of fuel gas in a pilot burner in accordance with variations in ambient temperature.

It is known to provide a gas-burning installation with a pilot burner which in addition to serving to ignite one or more gas jets is also used to effect a safety control mechanism by arranging that if the pilot light is extinguished for any reason the supply of gas to the whole installation is cut off. Moreover, the known mechanism can be arranged to effect the cutting off of the gas supply not only if the pilot burner is extinguished by, for example, a temporary disruption in gas supply thereto but also when the flame is extinguished because of a reduction in the oxygen content of the atmosphere in which the pilot burner is operating. In order that the pilot burner shall be sufficiently sensitive to the oxygen content of the atmosphere to provide gas cut off at a predetermined depleted oxygen content, and at the same time to ignite and burn satisfactorily in a normal atmosphere at a wide range of operating temperatures, it has been found necessary to control the amount of atmospheric air mixed with the fuel gas in the burner according to the ambient temperature. Hitherto, the control of the mixture of air with the gas has been effected by controlling the size of the air port through which air is induced into the burner tube, but apparatus for achieving this objective has suffered from the disadvantages of being complicated to manufacture and susceptible to interference by accumulation of lint around the air intake port, and it is an object of the invention to obviate the above mentioned disadvantages.

According to the present invention there is provided in apparatus for inducing ambient gas into a fluid stream and comprising a duct for said stream, which duct has at least one port through which ambient gas may enter the duct and a constriction upstream of the at least one port with reference to the direction of flow of the stream, means for varying the resistance to the flow of fluid along the duct downstream of said at least one port.

The resistance varying means may comprise a choke, adjustable within the duct for controlling the effective internal cross section thereof. The choke may take the form of a pin arranged for projection into the interior of the duct through an opening therein. The adjustment of the choke may be effected by a bi-metallic strip.

Embodiments of the invention will now be described by way of example and with reference to the accompanying drawings, of which:

Figure 1:
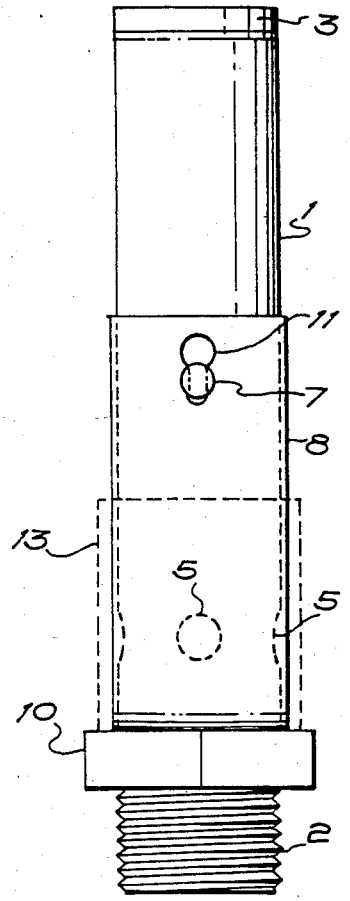
FIG. 1 is a side elevation of pilot burner.

As shown in the Figures the pilot burner comprises a burner tube 1 which is threaded at one end 2 for connection to a gas supply and provided at the other end with a ceramic ring 3 defining a flame port.

Near the end 2 which in use is the lower end of the burner there is a constriction whereby the internal diameter of the tube is reduced to a fine orifice 4. Above the orifice 4, the tube 1 is pierced by four air ports 5 through which, in use, air is admitted into the tube under the influence of the flow of gas passing upwardly from the orifice 4 into the wider upper portion of the tube.

Between the air ports 5 and the flame port 3 the tube is provided with an opening through which a choke pin 7, attached at one end to a flexible bi-metallic strip 8 can be introduced into the interior of the tube. The introduction of the pin 7 into the interior of the tube increases the resistance of the tube to the flow of gas therealong, the increased resistance varying according to the extent of penetration of the pin.

The bi-metallic strip is of a type known in the art and is bent to provide a horizontal portion 9 which is provided with a hole enabling it to be slid along the tube from its upper end in assembly of the burner, and by which it is secured to the hexagonal flange 10 which also serves in threading the burner onto the gas supply.

It is found that when the resistance to flow of gas along the tube 1 above the orifice 4 is increased by reason of the partial or complete penetration of the pin 7, less air is induced into the gas stream through the ports 5 than when the resistance was lower, and accordingly the volumetric flow rate is reduced and the mixture passing out of the flame port 3 is more gas-rich.

Figure 3:
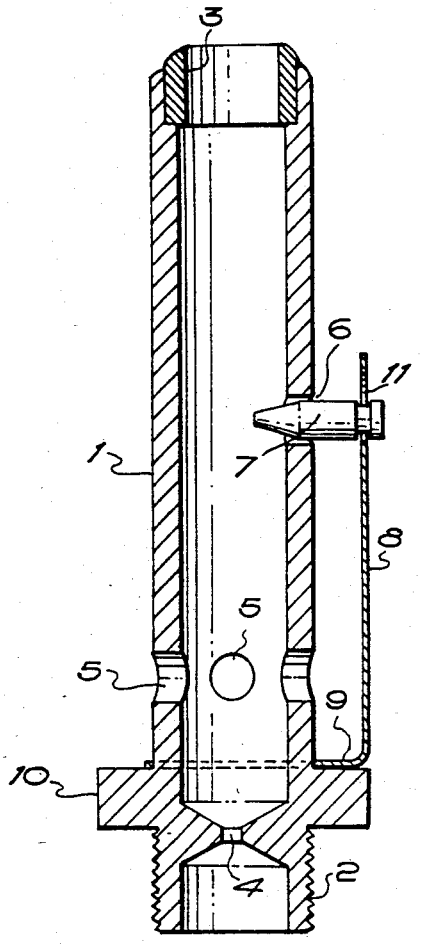
FIG. 3 is a section on lines III-III of FIG. 2.
Figure 2:
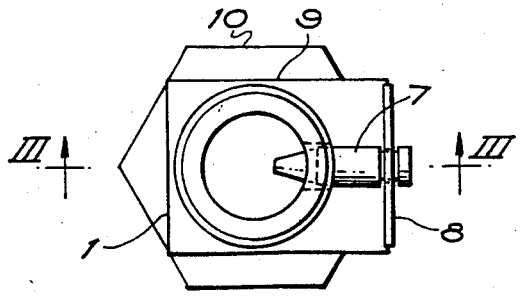
FIG. 2 is a plan view of the burner of FIG. 1.

The size of the choke pin 7 and the behaviour of the bi-metallic strip 8 are so arranged that in cold operating conditions the pin 7 penetrates fully into the tube 1 and increases the resistance to flow so greatly that a minimum of air is induced through the air ports 5 and the mixture passing out of the flame port is so rich in gas as to be readily ignitable even at the low temperature. The reduced volumetric flow rate also aids ignition. However, as the temperature in the region of the flame port and thereby in the region of the bi-metallic strip increases, for example as a heating appliance of which the burner forms a part warms up, the bi-metallic strip bends to the right as shown in FIG. 3, gradually withdrawing the pin 7 and so reducing the resistance to flow and increasing the induction of air through the ports 5 until, at a temperature which is regarded as normal operating temperature, the free end of the pin 7 is located within the opening 6 where it has little or no influence on the resistance to the gas flow in the tube.

It may be in extremely warm ambient conditions the pin 7 will be withdrawn to the outside of the tube 1, and for this reason the pin is tapered towards its free end so that it may readily re-locate in the opening 6 when, on cooler conditions obtaining, the metallic strip 8 moves to the left in the figure.

The pin 7 is provided with an annular groove by which it is loosely retained in keyhole slot 11 formed in the strip 8.

Because the control of the induced air is not in this burner effected by varying the size of the air inlet ports 5, these may be made considerably larger than in other burners with the advantage that the rate of air flow therethrough is reduced and the possibility of the air stream carrying particulate material along with it is diminished. However, if the pilot burner is to be operated in a particularly contaminated atmosphere, the burner may be provided with a cylindrical mesh sleeve 13 to act as a filter for the incoming air.

I claim:

1. Apparatus for inducing ambient air into a fuel gas stream and comprising a duct for said stream, which duct has at least one port through which ambient air may enter the duct and a constriction upstream of the at least one port with reference to the direction of flow of the stream, and means located along the duct downstream of said at least one port, for varying the resistance to the flow of gas and also the induction of said ambient air, said resistance varying means comprising a choke adjustable within said duct for controlling the effective internal cross-section thereof, said choke comprising a pin arranged for variable projection into the interior of said duct through an opening therein, wherein the variation of the projection of said pin is effected by means of a bi-metallic strip.

* * * * *